US005362587A

United States Patent [19]

Hashimoto et al.

[11] Patent Number: 5,362,587

[45] Date of Patent: Nov. 8, 1994

[54] ELECTROPHOTOGRAPHIC PHOTOSENSITIVE MEMBER HAVING AN INTERMEDIATE LAYER COMPRISING A PLURALITY OF POLYETHER POLYOLS

[75] Inventors: Yuichi Hashimoto, Tokyo; Takashi Koyama, Yokohama, both of Japan

[73] Assignee: Canon Kabushiki Kaisha, Tokyo, Japan

[21] Appl. No.: 112,234

[22] Filed: Aug. 27, 1993

Related U.S. Application Data

[63] Continuation of Ser. No. 860,604, Mar. 30, 1992, abandoned, which is a continuation of Ser. No. 536,298, Jun. 7, 1990, abandoned.

[30] Foreign Application Priority Data

Jun. 8, 1989 [JP] Japan ..... 1-146219
Jun. 12, 1989 [JP] Japan ..... 1-150058

[51] Int. Cl.[5] ..... G03G 5/05

[52] U.S. Cl. ..... 430/58; 430/59; 430/60; 430/96

[58] Field of Search ..... 430/58, 59, 60, 96

[56] References Cited

U.S. PATENT DOCUMENTS 4,863,822 12/1989 Fukagai et al. ..... 430/58

OTHER PUBLICATIONS

Patent Abstracts of Japan, vol. 12, No. 468 (P-797) (3315), Dec. 8, 1988.

Patent Abstracts of Japan, vol. 12, No. 147 (P-698) (2994), May 7, 1988.

*Primary Examiner*—Steve Rosasco

*Attorney, Agent, or Firm*—Fitzpatrick, Cella, Harper & Scinto

[57] ABSTRACT

According to the The present invention, there are provided an electrophotographic photosensitive member, an electrophotographic apparatus comprising the electrophotosensitive member, and a facsimile system comprising the electrophotographic apparatus. The electrophotographic photosensitive member comprises a conductive support, a photosensitive layer and an intermediate layer interposed therebetween. The intermediate layer comprises a material derived from an isocyanate compound and a plurality of kinds of polyether polyol compounds, the polyether polyol compounds meeting at least one of the following requirements i) and ii):

i) a ratio of a weight average molecular weight of at least one polyether polyol compound to a weight average molecular weight of at least one other polyether polyol compound is 1.3 or more; and ii) at least one polyether polyol compound has different functionality from that in at least one other polyether polyol compound.

8 Claims, 1 Drawing Sheet

ELECTROPHOTOGRAPHIC PHOTOSENSITIVE MEMBER HAVING AN INTERMEDIATE LAYER COMPRISING A PLURALITY OF POLYETHER POLYOLS

This application is a continuation of application Ser. No. 07/860,604 filed Mar. 30, 1992, now abandoned; which in turn, is a continuation of application Ser. No. 07/536,298, filed Jun. 7, 1990now abandoned.

BACKGROUND OF THE INVENTION

1. Field of the Invention

The present invention relates to an electrophotographic photosensitive member. More particularly, it relates to an electrophotographic photosensitive member comprising an intermediate layer provided between a conductive support and a photosensitive layer.

2. Related Background Art

In general, in electrophotographic photosensitive members of a Carson type, the stabilities at dark portion potential and light portion potential are important in order to form a good image having a constant image density and also free of defects in the course of the repetition of charging and exposure.

For this reason, it has been hitherto proposed that an intermediate layer having the functions of, e.g., improving the injection of charge from a support to a photosensitive layer, improving the adhesion between a support and a photosensitive layer, and improving coating performance for a photosensitive layer is provided between a support and a photosensitive layer.

A number of proposals have been also made on the so-called function-separated photosensitive member, comprising a photosensitive layer having a laminated structure formed of a charge generation layer and a charge transport layer. In this case, the charge generation layer is usually provided as a very thin layer with a thickness of, for example, about 0.5 μm, and its film thickness non-uniformity is closely related with the sensitivity non-uniformity of a photosensitive member. As the cause of the film thickness non-uniformity may be named defects, scratches or stains on the surface of a photosensitive member. From this viewpoint also, the intermediate layer is considered to be of very high necessity.

As materials to form the layer provided between a photosensitive member and a support, it is conventionally known to use polyamides (Japanese Patent Laid-open No. 46-47344 and No. 52-25638), polyesters (Japanese Patent Laid-open No. 54-20836 and No. 54-26738), casein (Japanese Patent Laid-open No. 55-103556), polypeptides (Japanese Patent Laid-open No. 53-48523), polyvinyl alcohols (Japanese Patent Laid-open No. 52-100240), polyvinyl pyrrolidone (Japanese Patent Laid-open No. 48-30936), a vinyl acetate/ethylene copolymer (Japanese Patent Laid-open No. 48-26141), a maleic anhydride ester polymer (Japanese Patent Laid-open No. 52-10138), polyvinyl butyral (Japanese Patent Laid-open No. 57-90639 and No. 58-106549), quaternary ammonium salt-containing polymers (Japanese Patent Laid-open No. 51-126149 and No. 56-60448), ethyl cellulose (Japanese Patent Laid-open No. 55-143564), etc.

In photosensitive members that use the above materials as the intermediate layer, however, the potential tends to change under the environmental influence of temperature and humidity, and it has been difficult to obtain potential characteristics and images that can be always stable to all environmental conditions of from the low temperature and low humidity to the high temperature and high humidity.

For example, when a photosensitive member is repeatedly used under conditions of low temperature and low humidity that increase the resistance of the intermediate layer, electric charge remains in the intermediate layer and hence the light portion potential and residual potential increase to cause fog on a copied image. When such a photosensitive member is used in a printer of an electrophotographic system in which reversal development is carried out, there have been the problems that the resulting image has a low density and no copies with constant image quality are obtainable.

Under conditions of high temperature and high humidity, the function as a barrier is lowered because of the intermediate layer having turned to have a low resistance, resulting in a lowering of the dark portion potential because of an increase in the injection of carriers from the support side. Thus, under conditions of the high temperature and high humidity, there have been the problems that the resulting copied image has a low density, and faulty black dots or fogged images tend to be formed when such a photosensitive member is used in the printer of an electrophotographic system in which reversal development is carried out.

Particularly in a lamination type electrophotographic photosensitive member comprising a photosensitive layer formed of a charge generation layer and a charge transport layer which are successively laminated, a charge generation layer containing a charge-generating material in a high concentration is positioned on an intermediate layer in contact therewith. Hence, a lowering of potential tends to occur because of an increase in the injection of carriers from the support side, so that even a slight lowering of the barrier function of the intermediate layer tends to generate fog in the printer of a reverse development type.

As a countermeasure to this problem, proposals have been made on an intermediate layer with a system comprising a conductive powder dispersed in a binder resin having a relatively high resistivity, as exemplified by a conductive powder dispersed in a polyester polyurethane (Japanese Patent Laid-open No. 61-163346), titanium (IV) oxide or tin (II) oxide dispersed in an acrylic polyurethane (Japanese Patent Laid-open No. 62-280863), and carbon black dispersed in an acrylic polyol or an isocyanate (Japanese Patent Laid-open No. 62-115467). Such systems can reduce characteristics variations due to temperature and humidity, but are comprised of a resin part having a high resistivity and a powder part having a very high conductivity which are present together. Hence, charge tends to be non-uniformly injected from the support side into a photosensitive layer. This may result in a lowering of potential in the case of the printer of a reverse development system, bringing about the problem that faulty black dots or fogged images tend to be formed.

When a photosensitive member comprised of such an intermediate layer is repeatedly used, charge is accumulated at the resin part having a high resistivity, with an increase in the speed of electrophotographic processing, to bring about another problem that the residual potential may increase.

SUMMARY OF THE INVENTION

An object of the present invention is to provide an electrophotographic photosensitive member capable of providing potential characteristics and images that are stable to all environmental conditions of from the low temperature and low humidity to the high temperature and high humidity.

Another object of the present invention is to provide an electrophotographic photosensitive member that can suppress light portion potential from increasing and dark portion potential from varying even when it is repeatedly used.

Still another object of the present invention is to provide an electrophotographic photosensitive member that can provide a defect-free, good image by the formation of an intermediate layer capable of well covering up defects present on a support.

Stated summarily, according to the present invention, an electrophotographic photosensitive member is provided, which comprises a conductive support, a photosensitive layer and an intermediate layer interposed therebetween, characterized in that said intermediate layer comprises a material derived from an isocyanate compound and a plurality of kinds of polyether polyol compounds, the polyether polyol compounds meeting at least one of the following requirements i) and ii):

i) a ratio of a weight average molecular weight of at least one polyether polyol compound to a weight average molecular weight of at least one other polyether polyol compound is 1.3 or more; and ii) at least one polyether polyol compound has different functionality from that in at least one other polyether polyol compound.

DESCRIPTION OF THE PREFERRED EMBODIMENTS

Figure 1:
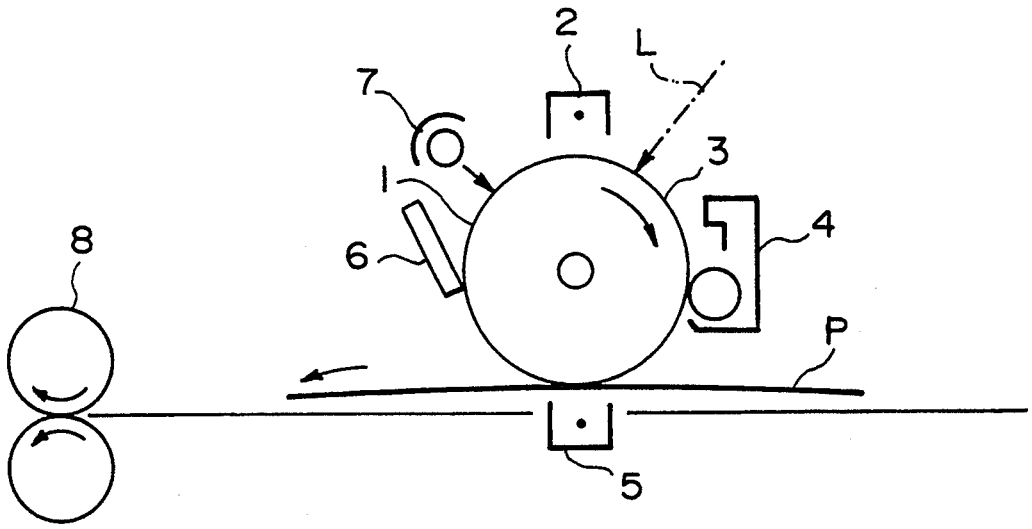
FIG. 1 schematically illustrates an example for the constitution of an electrophotographic apparatus in which an electrophotographic photosensitive member of the present invention is used.

The polyether polyurethane used in the present invention is a polymer formed by polymerization or copolymerization of a polyether polyol compound with an isocyanate compound.

The polyether polyol compounds used in the present invention may preferably comprise plural kinds of compounds having different weight average molecular weights. Use of the polyether polyol component satisfying this condition makes it possible, in particular, to suppress resistance from increasing under conditions of a low temperature and low humidity, compared with an instance in which a single polyol compound is used, so that a smooth coating film can be formed on a support. It also makes it possible to obtain a sufficient barrier function even under conditions of high temperature and high humidity, so that a decrease in dark portion potential can be made smaller. In particular, the polyether polyol compounds in which the ratio of a weight average molecular weight of at least one polyether polyol compound to a weight average molecular weight of at least one polyether polyol compound is in a value of not less than 1.3 is preferred in view of the stability of potential.

The polyether polyol compounds used in the present invention may also preferably contain at least one polyether polyol compound having different functionality from that in at least one other polyether polyol. Compared with an instance in which a single polyol component is used, use of the polyether polyol compound satisfying this condition makes the cross-linking of polyurethane chains irregular, so that the flexibility of an intermediate layer coating film can be improved. Hence, an increase in resistance of the intermediate layer can be suppressed even under conditions of low temperature and low humidity. Thus, it becomes possible to suppress light portion potential from increasing when a photosensitive member is repeatedly used, and to form a smooth and uniform coating film on a support because of the good flexibility.

The polyether polyol compound used in the present invention includes poly(oxyalkylene) glycols such as poly(oxypropylene) glycol, poly(oxypropylene) poly(oxyethylene) glycol, poly(oxybutylene) glycol, and poly(oxytetramethylene) glycol; poly(oxyalkylene) triols such as poly(oxyethylene) triol, poly(oxypropylene) triol, poly(oxypropylene) poly(oxyethylene) triol, and poly(oxybutylene) triol; and poly(oxyalkylene) polyols such as poly(oxypropylene) polyol and poly(oxypropylene) poly(oxyethylene) polyol formed using ethylene diamine, pentaerythritol, sorbitol, sucrose, starch or the like as an initiator.

The isocyanate compound used in the present invention includes aromatic isocyanate compounds such as tolylene diisocyanate, methaxylylene diisocyanate, diphenylmethane diisocyanate, and polymethylene polyphenylene isocyanate; hydrogenated products of the above isocyanates; aliphatic isocyanate compounds such as hexamethylene diisocyanate; and block isocyanate compounds in which isocyanate groups of the above isocyanate compound are blocked with a phenol, a ketoxime, an aromatic secondary amine, a tertiary alcohol, an amide, a lactam, a heterocyclic compound or a sulfite.

The above isocyanate compound may also be used in the form of a dimer to a pentamer.

As a catalyst to accelerate the reaction for producing the polyether polyurethane by polymerization of the above polyether polyol compound with isocyanate compound, it is possible to use naphthenates such as cobalt naphthenate, and magnesium naphthenate; tin oxides such as dibutyltin dilaurate, dimethyltin dilaurate, and stannous chloride; and amine compounds such as triethylenediamine, N-methylmorpholine, and N,N,N',N'-tetramethylpolymethylenediamine. The catalyst may preferably be added in an amount of from 0.001 to 5% by weight based on the polymer.

The isocyanate groups (NCO group) and hydroxy groups (OH group) in a polymer material should be appropriately in a molar ratio of:

$1.0 \leqq \text{NCO group/OH group} \leqq 2.0$.

A molar ratio lower than 1.0 may make poor the sensitivity of a photosensitive member and also tends to cause a lowering of barrier properties of the intermediate layer under conditions of high temperature and high humidity. On the other hand, a molar ratio larger than 2.0 tends to result in a lowering of adhesion properties of a coating film.

In the polyol components contained in the intermediate layer, at least one polyether polyol compound having a higher weight average molecular weight and at least one other polyether polyol compound having a lower weight average molecular weight may each preferably be in an amount of not less than 20% by weight, the weight average molecular weight ratio of the higher one to the lower one being 1.3 or more. The compounds having different functionality may each preferably be in an amount of not less than 5% by weight.

On the other hand, the conductive material used in the intermediate layer of the present invention includes metal powders, scaly metal powders and metal short fibers of aluminum, copper, nickel or silver; conductive metal oxides such as antimony oxide, indium oxide, and tin oxide; polymeric conductive materials such as polyvinyl, polyaniline, polythiophene, and polymeric electrolyte; carbon fiber, carbon black, and graphite powder; organic or inorganic electrolytes and metal complexes; and conductive powders whose particle surfaces are coated with any of these conductive materials.

The conductive material and the resin may be mixed in a ratio of from about 5:1 to 1:5, and preferably from 4:1 to 1:3. This mixing ratio may be determined by taking account of the resistivity, surface properties, coating suitability, etc. of the intermediate layer.

In the case when the conductive material comprises a powder, it may be used in the form of a mixture prepared by a conventional method using a ball mill, a roll mill, a sand mill or the like.

A surface active agent, a silane coupling agent, a titanate coupling agent, a silicone oil, a silicone leveling agent and so forth may also be added as other additives.

The intermediate layer of the present invention may be formed by a method in which the polymer obtained from a polyol compound and an isocyanate compound and the conductive material are dissolved or dispersed in a suitable solvent, and then the solution or dispersion is coated and dried. Alternatively, it may be formed by a method in which a mixture of a polyol compound and an isocyanate compound which are unreacted or a prepolymer of a polyol compound and isocyanate compound which have been partially reacted is dissolved or dispersed in a suitable solvent together with the conductive material, and thereafter the solution or dispersion is coated and reacted to cure.

The thickness of the intermediate layer of the present invention is set by taking account of defects such as scratches and dents on the surface of a photosensitive member. It may be commonly set in the range of from about 0.1 to about 50 μm, and preferably from 1 to 30 μm.

The intermediate layer can be formed by coating methods such as dip coating, spray coating, and roll coating.

In the present invention, a second intermediate layer mainly composed of a resin may also be optionally provided on the above intermediate layer for the purpose of, e.g., controlling barrier properties.

The resin material used in the second intermediate layer includes polyamides, polyurethanes, polyureas, polyesters, and phenol resins.

The second intermediate layer may preferably have a thickness of from 0.1 μm to 5 μm, and can be formed by coating in the same manner as in the first-mentioned intermediate layer.

In the present invention, the photosensitive layer may be of either laminated structure functionally separated into a charge generation layer and a charge transport layer, or single layer structure.

In the case of the photosensitive layer of laminated structure, the charge generation layer can be formed by dispersing an organic charge-generating material including azo pigments such as Sudan Red and Direct Blue, quinone pigments such as pyrenequinone and anthanthrone, quinocyanine pigments, perylene pigments, indigo pigments such as indigo and thioindigo, azulenium salt pigments, and phthalocyanine pigments such as copper phthalocyanine and titanyl oxophthalocyanine, in a binder resin such as polyvinyl formal, polyvinyl butyral, polycarbonate, polystyrene, polyvinyl acetate, acrylic resins, polyvinyl pyrrolidone, ethyl cellulose, or cellulose acetate, and coating the resulting dispersion on the first-mentioned intermediate layer. Such a charge generation layer may have a film thickness of not more than 5 μm, and preferably from 0.05 μm to 2 μm.

The charge transport layer may be formed using a coating solution obtained by optionally dissolving an organic charge-transporting material including polycyclic aromatic compounds with the structure having biphenylene, anthracene, pyrene, phenanthrene or the like at a main chain or a side chain, nitrogen-containing cyclic compounds such as indole, carbazole, oxadiazole and pyrazoline, hydrazone compounds, and styryl compounds, in a resin having film-forming properties.

The resin having such film-forming properties includes polyesters, polycarbonate, polymethacrylate, and polystyrene.

The charge transport layer may have a thickness of from 5 μm to 40 μm, and preferably from 10 μm to 30 μm.

The photosensitive member of the laminate structure type may have the structure in which the charge generation layer is laminated on the charge transport layer.

In the case of the photosensitive member of the single layer type, it can be formed by incorporating into the resin the charge-generating material and charge-transporting material as described above.

In the present invention, a layer of an organic photoconductive polymer such as polyvinyl carbazole or polyvinyl anthracene, a selenium-deposited layer, a selenium-tellurium-deposited layer, or an amorphous silicone layer may also be used as the photosensitive layer.

The conductive support used in the present invention may be comprised of any supports so long as they are conductive, and include, for example, those comprising a metal such as aluminum, copper, molybdenum, chromium, nickel, or brass, molded or formed into drums or sheets, those comprising a plastic film laminated thereon with foil of a metal such as aluminum or copper, those comprising a plastic film on which aluminum, indium oxide, tin oxide or the like has been deposited, or metals, plastic films, papers or the like comprising a conductive layer provided by coating a conductive material alone or together with a suitable binder resin.

The electrophotographic photosensitive member of the present invention can be applied generally in electrophotographic apparatus such as copying machines, laser beam printers, LED printers, LCD printers (or liquid crystal shutter printers) and micro-reader printers. It can also be widely used in apparatus for display, recording, personal printing, lithography, facsimile and so forth in which electrophotography is applied.

FIG. 1 schematically illustrates an example of the constitution of a transfer electrophotographic apparatus in which a drum photosensitive member according to the present invention is used.

In FIG. 1, the numeral 1 denotes a drum photosensitive member serving as an image supporting member, which is rotated around a shaft 1*a* at a given peripheral speed in the direction shown by arrow. In the course of rotation, the photosensitive member 1 is uniformly charged on its periphery, with positive or negative given potential by the operation of a charging means 2, and then photoimagewise exposed to light L (slit exposure, laser beam scanning exposure, etc.) at an exposure area 3 by the operation of an image exposure means (not shown). As a result, electrostatic latent images corresponding to the exposure images are successively formed on the periphery of the photosensitive member.

The electrostatic latent images thus formed are subsequently developed with toner by the operation of a developing means 4. The resulting toner-developed images are then successively transferred by the operation of a transfer means 5, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is subjected to removal of the toner remaining after the transfer, using a cleaning means 6. Thus the photosensitive member is cleaned on its surface and then repeatedly used for the formation of images.

The charging means 2 for giving uniform charge on the photosensitive member 1 include corona chargers, which are commonly put into wide use. As the transfer means 5, corona transfer units are also commonly put into wide use.

The electrophotographic apparatus may be constituted of a combination of plural components joined as one apparatus unit from among the constituents such as the above photosensitive member, developing means and cleaning means so that the unit can be freely mounted on or detached from the body of the apparatus. For example, the photosensitive member 1 and the cleaning means 6 may be joined into one apparatus unit so that the unit can be freely mounted or detached using a guide means such as a rail provided in the body of the apparatus. Here, the above apparatus unit may be so constituted as to be joined together with the charge means and/or the developing means.

In the case when the electrophotographic apparatus is used as a copying machine or a printer, optical image exposure to light L is performed by reading of light reflected from, or transmitted through, an original, or the original itself, conversion of the light read to a signal, scanning of a laser beam according to the signal, driving of a light-emitting diode array, driving of a liquid crystal shutter array, etc.

Figure 2:
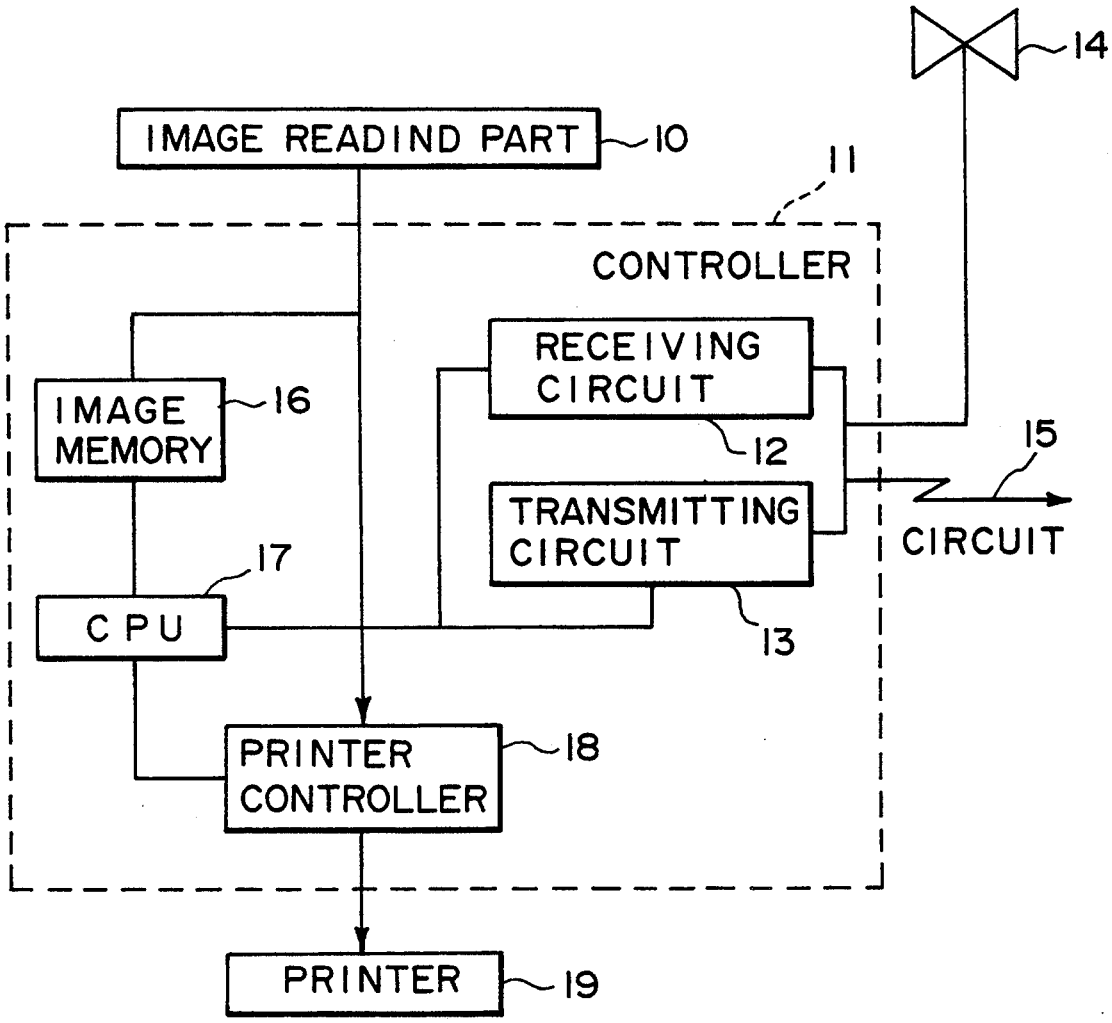
FIG. 2 is a block diagram of a facsimile system in which an electrophotographic apparatus comprised of an electrophotographic photosensitive member of the present invention is used as a printer.

When used as a printer of a facsimile system, the optical image exposure to light L serves as exposure used for the printing of received data. FIG. 2 illustrates an example thereof in the form of a block diagram.

In FIG. 2, a controller 11 controls an image reading part 10 and a printer 19. The whole of the controller 11 is controlled by CPU 17. Image data outputted from the image reading part is sent to the other facsimile station through a transmitting circuit. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the decoded image information for one page to the printer controller 18. The printer controller 18, having received the image information for one page from the CPU 17, controls the printer 19 so that the image information for one page is recorded.

The CPU 17 receives image information for next page in the course of the recording by the printer.

Images are received and recorded in the above way.

EXAMPLES

The present invention will be described below in greater detail by giving Examples. Unless otherwise specified, all parts are by weight.

Example 1 & Comparative Example 1

Titanium oxide powder coated with tin oxide containing

| | |
|---|---|
| 10% of antimony oxide | 50 parts |
| Resol type phenol resin | 25 parts |
| Methyl cellosolve | 20 parts |
| Methanol | 5 parts |
| Silicone oil (a dimethylpolysiloxane/polyoxyalkylene copolymer; weight average molecular weight: 3.500) | 0.002 part |

The above materials were dispersed for 1 hour by means of a sand mill in which glass beads of 1 mm in diameter were used. A conductive layer coating solution was thus prepared.

The above coating solution was applied by dip coating to a 60 mm (diameter)×260 mm aluminum cylinder, followed by drying at 140° C. for 30 minutes. A conductive layer with a film thickness of 20 μm was thus formed.

Next, the following two kinds of coating solutions were prepared as intermediate layer coat solutions.

| | |
|---|---|
| Intermediate resin layer (A): | |
| Poly(oxypropylene) triol (hydroxyl value: 148.9 mg · KOH/g; weight average molecular weight: 1,130) | 2.8 parts |
| Poly(oxypropylene) triol (hydroxyl value: 114.5 mg · KOH/g; weight average molecular weight: 1,470) | 2.8 parts |
| Dibutyltin dilaurate | 0.02 part |
| Methyl ethyl ketone (MEK) | 80 parts |
| Intermediate resin layer (B): | |
| Poly(oxypropylene) triol (hydroxyl value: 114.5 mg · KOH/g; weight average molecular weight: 1470) | 6.2 parts |

-continued

| | |
|---|---|
| Dibutyltin dilaurate | 0.02 part |
| MEK | 80 parts |

To each solution, 5.5 parts of a ketoxime blocked compound of hexamethylene diisocyanate (effective NCO group: 11.6% by weight) was added to prepare an intermediate layer coating solution so as to give a molar ratio of NCO group:OH group=1.2:1.

Each of the resulting solutions was applied by dip coating to the above conductive layer, followed by drying and curing at 180° C. for 40 minutes. An intermediate layer with a film thickness of 1.2 μm was thus formed.

Next, 10 parts of trisazo pigment of the following structural formula:

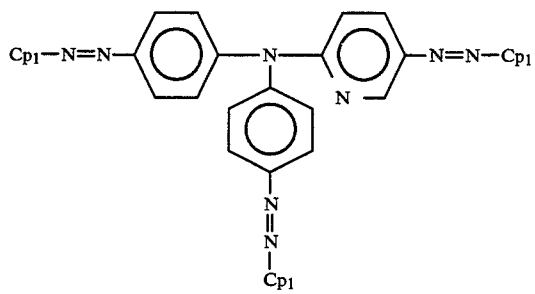

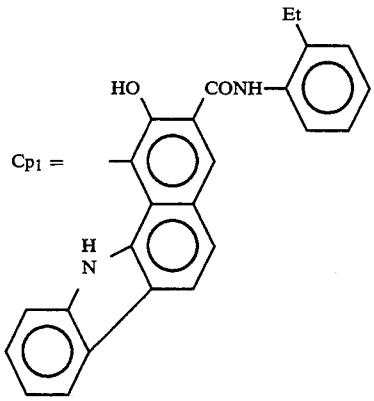

5 parts of polymethyl methacrylate (number average molecular weight: 11,000) and 60 parts of cyclohexanone were dispersed by means of a sand mill in which glass beads of 0.5 mm in diameter were used, and then 120 parts of MEK was added. A dispersion was thus prepared. This dispersion was applied by dip coating to the above intermediate layer, followed by drying at 80° C. for 20 minutes. A charge generation layer with a coating weight of 0.15 g/m$^2$ was thus formed.

Next, 10 parts of a stilbene compound of the following structural formula:

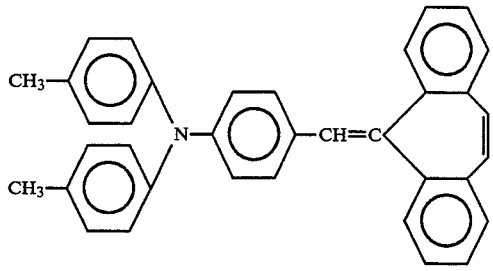

and 10 parts of polycarbonate (weight average molecular weight: 8,000) were dissolved in a mixed solvent of 40 parts of dichloromethane and 20 parts of monochlorobenzene. The resulting solution was applied by dip coating to the above charge generation layer, followed by drying at 120° C. for 60 minutes. A charge transport layer with a film thickness of 20 μm was thus formed.

Photosensitive members thus prepared were each fitted to a laser beam printer (LBP-CX, manufactured by Canon Inc.), and electrophotographic performance was evaluated under environmental conditions of normal temperature and normal humidity (23° C., 55% RH) and also under conditions of high temperature and high humidity (33° C., 90% RH).

As a result, as Table 1 shows, both had a good sensitivity, and a sufficient potential contrast was obtained with a great difference between dark portion potential (Vd) and light portion potential (Vl). Under conditions of high temperature and high humidity, the photosensitive member having the intermediate layer (A) of the present invention showed stable dark portion potential (Vd), and good images free from black dots and fog were obtained. On the other hand, the photosensitive member having the intermediate layer (B) containing only a single polyol component showed image defects caused by a defective coating film.

In the meantime, images were continuously produced on 1,000 sheets of paper under conditions of low temperature and low humidity (15° C., 10% RH). As a result, the photosensitive member having the intermediate layer (A) of the present invention caused no increase in light portion potential (Vl), and very stable images were obtained. On the other hand, the photosensitive member having the intermediate layer (B) caused a serious increase in light portion potential (Vl), bringing about a lowering of image density.

There was also an appearance of slight cissing in the intermediate layer (B), but a smooth coating film was obtained in the intermediate layer (A) of the present invention.

Example 2 & Comparative Example 2

The following two kinds of coating solutions were prepared as intermediate layer coating solutions.

| Intermediate resin layer (C): | |
|---|---|
| Poly(oxypropylene) glycol (hydroxyl value: 267.1 mg · KOH/g; weight average molecular weight: 420) | 1.1 parts |
| Poly(oxypropylene) glycol (hydroxyl value: 133.6 mg · KOH/g; weight average molecular weight: 840) | 2.2 parts |
| Dibutyltin dilaurate | 0.02 part |
| MEK | 80 parts |

-continued

| Intermediate resin layer (D): | |
|---|---|
| Poly(oxypropylene) glycol (hydroxyl value: 267.1 mg · KOH/g; weight average molecular weight: 840) | 2.0 parts |
| Dibutyltin dilaurate | 0.02 part |
| MEK | 80 parts |

Example 1 was repeated to prepare photosensitive members, except for using a coating solution with a molar ratio of NCO group:OH group=1.5:1 obtained by dissolving in each solution 5.2 parts of a ketoxime blocked compound of hexamethylene diisocyanate (effective NCO group: 11.6% by weight). Evaluation was also made in the same way.

As a result, as Table 1 shows, stable characteristics were obtained in both cases under conditions of normal temperature and normal humidity. Under conditions of low temperature and low humidity, however, the photosensitive member having the intermediate layer (D) containing only a single polyol compound caused a serious increase in light portion potential (Vl), bringing about a lowering of image density.

There was also an appearance of slight non-uniformity in the intermediate layer (D), but a smooth coating film was obtained in the intermediate layer (C) of the present invention.

Example 3 & Comparative Example 3

The following two kinds of coating solutions were prepared as intermediate layer coating solutions.

| Intermediate resin layer (E): | |
|---|---|
| Poly(oxypropylene) polyol formed using pentaerythritol as an initiator (hydroxyl value: 118.1 mg · KOH/g; weight average molecular weight: 1,900) | 4.8 parts |
| Poly(oxypropylene) polyol formed using pentaerythritol as an initiator (hydroxyl value: 78.7 mg · KOH/g; weight average molecular weight: 2,850) | 9.6 parts |
| Triethylenediamine | 0.3 part |
| Isobutyl acetate | 100 parts |
| Intermediate resin layer (F): | |
| Poly(oxypropylene) polyol formed using pentaerythritol as an initiator (hydroxyl value: 196.8 mg · KOH/g; weight average molecular weight: 1140) | 6.5 parts |
| Triethylenediamine | 0.3 part |
| Isobutyl acetate | 100 parts |

Example 1 was repeated to prepare photosensitive members, except for using a coating solution with a molar ratio of NCO group:OH group=1.4:1 obtained by dissolving in each solution 3.0 parts of meta-xylylene diisocyanate. Evaluation was also made in the same way.

As a result, as Table 1 shows, stable characteristics were obtained in both cases under conditions of normal temperature and normal humidity. Under conditions of high temperature and high humidity, however, the photosensitive member having the intermediate layer (F) containing only a single polyol compound caused many image defects. Under low temperature and low humidity, the photosensitive member having the intermediate layer (F) caused a serious increase in light portion potential (Vl), bringing about a lowering of image density.

There was also an appearance of much cissing in the intermediate layer (F), showing very poor coating properties. On the other hand, a smooth coating film was obtained in the intermediate layer (E) of the present invention.

Example 4 & Comparative Example 4

The following two kinds of coating solutions were prepared as intermediate layer coating solutions.

| Intermediate resin layer (G): | |
|---|---|
| Poly(oxypropylene) triol (hydroxyl value: 374 mg · KOH/g; weight average molecular weight: 450) | 1.8 parts |
| Poly(oxypropylene) triol (hydroxyl value: 233.8 mg · KOH/g; weight average molecular weight: 720) | 1.8 parts |
| Dibutyltin dilaurate | 0.02 part |
| MEK | 80 parts |
| Intermediate resin layer (H): | |
| Poly(oxypropylene) triol (hydroxyl value: 374 mg · KOH/g; weight average molecular weight: 450) | 1.5 parts |
| Poly(oxypropylene) triol (hydroxyl value: 311.7 mg · KOH/g; weight average molecular weight: 540) | 1.5 parts |
| Dibutyltin dilaurate | 0.02 part |
| MEK | 80 parts |

Example 1 was repeated to prepare photosensitive members, except for using a coating coating solution with a molar ratio of NCO group:OH group=1.5:1 obtained by dissolving in each solution 10 parts of a ketoxime blocked compound of hexamethylene diisocyanate (effective NCO group: 11.6% by weight). Evaluation was also made in the same way.

As a result, as Table 1 shows, stable characteristics were obtained in both cases under conditions of normal temperature and normal humidity. Under conditions of low temperature and low humidity, however, the photosensitive member having the intermediate layer (H) in which the ratio of weight average molecular weights of the two polyols was 1:1.2 caused a serious increase in light portion potential, bringing about a lowering of image density.

There was also an appearance of non-uniformity in the intermediate layer (H), but a smooth coating film was obtained in the intermediate layer (G) of the present invention.

Example 5 & Comparative Example 5

The following two kinds of coating solutions were prepared as intermediate layer coating solutions.

| Intermediate resin layer (I): | |
|---|---|
| Poly(oxypropylene) triol (hydroxyl value: 70.1 mg · KOH/g: weight average molecular weight: 2,400) | 6.1 parts |
| Poly(oxypropylene) triol (hydroxyl value: 39.0 mg · KOH/g; weight average molecular weight: 4,320) | 9.1 parts |
| Triethylenediamine | 0.15 part |
| MEK | 100 parts |
| Intermediate resin layer (J): | |
| Poly(oxypropylene) triol (hydroxyl value: 46.8 mg · KOH/g; weight average molecular weight: 3,600) | 6.9 parts |
| Poly(oxypropylene) triol (hydroxyl value: 39.0 mg · KOH/g; weight average molecular weight: 4,320) | 10.3 parts |
| Triethylenediamine | 0.15 part |
| MEK | 100 parts |

To each solution, 2.0 parts of a tolylene diisocyanate was added to prepare an intermediate layer coating solution so as to give a molar ratio of NCO group:OH group=1.8:1.

Each of the resulting solutions was applied by dip coating to a conductive support, a 30 mm (diameter)×260 mm aluminum cylinder, followed by drying at 120° C. for 60 minutes. An intermediate layer with a film thickness of 0.8 μm was thus formed.

Next, 10 parts of disazo pigment of the following structural formula:

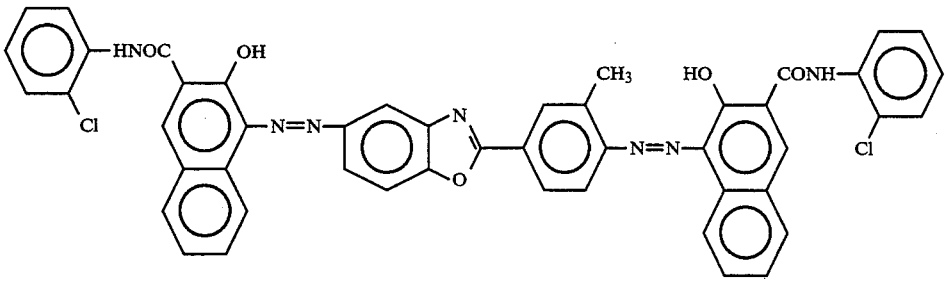

6 parts of polyvinyl butyral resin (degree of butyralation: 70%; number average molecular weight: 24,000) and 60 parts of cyclohexanone were dispersed by means of a sand mill in which glass beads of 1 mm in diameter were used. To the resulting dispersion, 100 parts of methyl ethyl ketone was added, and then the dispersion was applied by dip coating to the above intermediate layer, followed by drying at 100° C. for 10 minutes. A charge generation layer with a coating weight of 0.15 g/m$^2$ was thus formed.

Next, 10 parts of a hydrazone compound of the following structural formula:

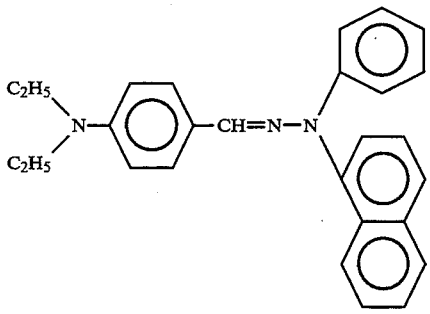

and 15 parts of a styrene/methyl methacrylate copolymer (styrene/methyl methacrylate=8/2; average molecular weight: 35,000) were dissolved in 80 parts of toluene. The resulting solution was applied by dip coating to the above charge generation layer, followed by hot-air drying at 100° C. for 1 hour. A charge transport layer with a thickness of 18 μm was thus formed.

Photosensitive members thus prepared were each fitted to a small-size copying machine (FC-5, manufactured by Canon Inc.), and electrophotographic performance was evaluated under environmental conditions of normal temperature and normal humidity (23° C., 55% RH) and also under conditions of high temperature and high humidity (33° C., 90% RH).

As a result, as Table 1 shows, both had a good sensitivity, and a sufficient potential contrast was obtained with a great difference between dark portion potential (Vd) and light portion potential (Vl). Under conditions of high temperature and high humidity, there occurred no variations of dark portion potential, and good images were obtained.

In the meantime, images were continuously produced on 1,000 sheets of paper under conditions of low temperature and low humidity (15° C., 10% RH). As a result, the photosensitive member having the intermediate layer (I) of the present invention caused no increase in light portion potential (Vl), and very stable images were obtained. On the other hand, the photosensitive member having the intermediate layer (J) containing the polyol compounds in a ratio of weight average molecular weights of 1:1.2 caused fog because of a serious increase in light portion potential (Vl). The intermediate layers (I) and (J) each had an appearance of a smooth coating film.

Example 6 & Comparative Example 6

The following two kinds of coating solutions were prepared as intermediate layer coating solutions.

| | |
|---|---|
| Intermediate resin layer (K): | |
| Poly(oxypropylene) glycol (hydroxyl value: 92.0 mg · KOH/g; weight average molecular weight: 1,220) | 1.7 parts |
| Poly(oxypropylene) glycol (hydroxyl value: 54.2 mg · KOH/g; weight average molecular weight: 2,070) | 7.0 parts |
| Dibutyltin dilaurate | 0.05 part |
| MEK | 100 parts |
| Intermediate resin layer (L): | |
| Poly(oxypropylene) glycol (hydroxyl value: 92.0 mg · KOH/g; weight average molecular weight: 1,220) | 2.2 parts |
| Poly(oxypropylene) glycol (hydroxyl value: 83.7 mg · KOH/g; weight average molecular weight: 1,340) | |
| Dibutyltin dilaurate | 0.05 part |
| MEK | 100 parts |

Example 1 was repeated to prepare photosensitive members, except for using a coating solution with a molar ratio of NCO group:OH group=1.3:1 obtained by dissolving in each solution 1.0 part of hexamethylene diisocyanate. Evaluation was also made in the same way.

As a result, as Table 1 shows, stable characteristics were obtained in both cases under conditions of normal temperature and normal humidity and also under conditions of high temperature and high humidity. Under conditions of low temperature and low humidity, however, the photosensitive member having the intermediate layer (L) containing the polyol compounds in a ratio of weight average molecular weights of 1:1.1 caused fog because of a serious increase in light portion potential (Vl).

There was also an appearance of non-uniformity in the intermediate layer (L). On the other hand, a smooth coating film was obtained in the intermediate layer (K) of the present invention.

Example 7 & Comparative Example 7

The following two kinds of coating solutions were prepared as intermediate layer coating solutions.

| Intermediate resin layer (M): | |
|---|---|
| Poly(oxypropylene) polyol formed using sorbitol as an initiator (hydroxyl value: 935 mg · KOH/g; weight average molecular weight: 360) | 2 parts |
| Poly(oxypropylene) polyol formed using sorbitol as an initiator (hydroxyl value: 426.1 mg · KOH/g; weight average molecular weight: 790) | 4 parts |
| Dibutyltin dilaurate | 0.02 part |
| MEK | 100 parts |
| **Intermediate resin layer (N):** | |
| Poly(oxypropylene) polyol formed using sorbitol as an initiator (hydroxyl value: 935 mg · KOH/g; weight average molecular weight: 360) | 1.9 parts |
| Poly(oxypropylene) polyol formed using sorbitol as an initiator (hydroxyl value: 841.5 mg · KOH/g; weight average molecular weight: 400) | 1.9 parts |
| Dibutyltin dilaurate | 0.02 part |
| MEK | 100 parts |

Example 1 was repeated to prepare photosensitive members, except for using a coating solution with a molar ratio of NCO group:OH group=1.6:1 obtained by dissolving in each solution 5.4 parts of hexamethylene diisocyanate. Evaluation was also made in the same way.

As a result, as Table 1 shows, stable characteristics were obtained in both cases under conditions of normal temperature and normal humidity. Under conditions of high temperature and high humidity, however, the photosensitive member having the intermediate layer (N) containing the polyol compounds in a ratio of weight average molecular weights of 1:1.1 caused many image defects. Under low temperature and low humidity, the photosensitive member having the intermediate layer (N) caused fog because of a serious increase in light portion potential (Vl).

There was also an appearance of much cissing in the intermediate layer (N). On the other hand, a smooth coating film was obtained in the intermediate layer (M) of the present invention.

TABLE 1

| Photosensitive member | (1) | (2) | (3) | (I) (23° C., 55% RH) Dark portion potential Vd [−V] | (I) Light portion potential Vl [−V] | (II) (33° C., 90% RH) Dark portion potential Vd [−V] | (4) | (III) (15° C., 10% RH) Dark p. potential, Vd [−V] Initial stage | Dark p. potential, Vd [−V] 1,000 sheets | Light p. potential, Vl [−V] Initial stage | Light p. potential, Vl [−V] 1,000 sheets |
|---|---|---|---|---|---|---|---|---|---|---|---|
| Ex. 1 | 1.2 | 1.3 | A | 720 | 150 | 710 | A' | 730 | 720 | 150 | 160 |
| Cp. 1 | 1.2 | — | B | 715 | 170 | 650 | B' | 735 | 750 | 200 | 345 |
| Ex. 2 | 1.5 | 2.0 | A | 705 | 120 | 695 | A' | 710 | 705 | 130 | 135 |
| Cp. 2 | 1.5 | — | C | 700 | 140 | 680 | A' | 710 | 705 | 170 | 290 |
| Ex. 3 | 1.4 | 1.5 | A | 700 | 125 | 695 | A' | 690 | 695 | 130 | 125 |
| Cp. 3 | 1.4 | — | D | 690 | 120 | 605 | C' | 700 | 720 | 165 | 240 |
| Ex. 4 | 1.5 | 1.6 | A | 710 | 110 | 705 | A' | 710 | 710 | 125 | 130 |
| Cp. 4 | 1.5 | 1.2 | C | 705 | 125 | 690 | A' | 700 | 705 | 150 | 335 |
| Ex. 5 | 1.8 | 1.8 | A | 695 | 115 | 695 | A' | 700 | 705 | 120 | 120 |
| Cp. 5 | 1.8 | 1.2 | A | 700 | 120 | 700 | A' | 710 | 705 | 140 | 225 |
| Ex. 6 | 1.3 | 1.7 | A | 725 | 125 | 715 | A' | 730 | 725 | 130 | 120 |
| Cp. 6 | 1.3 | 1.1 | C | 700 | 120 | 675 | A' | 730 | 725 | 130 | 195 |
| Ex. 7 | 1.6 | 2.2 | A | 725 | 145 | 720 | A' | 725 | 720 | 150 | 160 |
| Cp. 7 | 1.6 | 1.1 | D | 705 | 150 | 620 | C' | 720 | 750 | 170 | 300 |

Ex.: Example;
Cp.: Comparative Example
(I): Normal temperature and normal humidity;
(II): High temperature and high humidity
(III): Low temperature and low humidity
(1): Molar ratio of NCO group/OH group in material;
(2): Ratio of weight average molecular weight;
(3): Appearance of intermediate layer; A: smooth, B: slight cissing, C: non-uniform, D: much cissing
(4): Image; A': good, B': a little image defects, C': many image defects Example 8 & Comparative Example 8

Example 1 was repeated to prepare photosensitive members, except that the intermediate resin layers were replaced with the following two and the intermediate layer coating solutions were prepared without use of the ketoxime blocked compound of hexamethylene isocyanate.

| Intermediate resin layer (O): | |
|---|---|
| Copoly(oxypropylene)(oxyethylene) glycol (hydroxyl value: 22 mg · KOH/g) | 14.6 parts |
| Copoly(oxypropylene)(oxyethylene) glycol (hydroxyl value: 50 mg · KOH/g) | 6.4 parts |
| Tolylenediisocyanate | 1.5 part |
| Dibutyltin dilaurate | 0.01 part |
| **Intermediate resin layer (P):** | |
| Copoly(oxypropylene)(oxyethylene) glycol (hydroxyl value: 22 mg · KOH/g) | 29.3 parts |
| Tolylenediisocyanate | 1.5 part |
| Dibutyltin dilaurate | 0.01 part |

In these intermediate resin layers, the molar ratio of NCO group:OH group was 1:5. Each intermediate layer had a film thickness of 1.1. The charge generation layer had a coating weight of 0.15 g/m$^2$. The charge transport layer had a film thickness of 20 $\mu$m.

Evaluation was also made in the same way as in Example 1 except that a laser beam printer LBP-SX, manufactured by Canon Inc., was used.

As a result, as Table 2 shows, both had a good sensitivity, and a sufficient potential contrast was obtained with a great difference between dark portion potential (Vd) and light portion potential (Vl). Under conditions of high temperature and high humidity, the photosensitive member having the intermediate layer (O) containing the polyol components of a bifunctional group and a trifunctional group showed stable dark portion potential (Vd), and good images free from black dots and fog were obtained. On the other hand, the photosensitive member having the intermediate layer (P) containing only a single polyol component showed image defects caused by a defective coating film.

In the meantime, images were continuously produced on 1,000 sheets of paper under conditions of low temperature and low humidity (15° C., 10% RH). As a result, the photosensitive member having the intermediate layer (0) of the present invention caused no increase in light portion potential (Vl), and very stable images were obtained. On the other hand, the photosensitive member having the intermediate layer (P) caused a serious increase in light portion potential (Vl), bringing about a lowering of image density.

There was also an appearance of slight cissing in the intermediate layer (P), but a smooth coating film was obtained in the intermediate layer (O) of the present invention.

Example 9 & Comparative Example 9

The following two kinds of coating solutions were prepared as intermediate layer coating solutions.

| | |
|---|---|
| Intermediate resin layer (Q): | |
| Poly(oxypropylene) glycol formed using bisphenol A as an initiator (hydroxyl value: 300 mg · KOH/g) | 0.71 parts |
| Tetrafunctional poly(oxypropylene) polyol formed using ethylenediamine as an initiator (hydroxyl value: 760 mg · KOH/g) | 0.28 part |
| Ketoxime blocked compound mainly composed of hexamethylene diisocyanate (effective NCO group: 11.6 % by weight) | 1.2 parts |
| Dibutyltin dilaurate | 0.01 part |
| Intermediate resin layer (R): | |
| Poly(oxypropylene) glycol formed using bisphenol A as an initiator (hydroxyl value: 300 mg · KOH/g) | 1.4 parts |
| Ketoxime blocked compound mainly composed of hexamethylene diisocyanate (effective NCO group: 11.6 % by weight) | 1.2 parts |
| Dibutyltin dilaurate | 0.01 part |

In these intermediate resin layers (Q) and (R), the molar ratio of NCO group:OH group was 1.2:1.

Example 8 was repeated to prepare photosensitive members, except for using these coating solutions.

As a result, as Table 2 shows, stable characteristics were obtained in both cases under conditions of normal temperature and normal humidity. Under conditions of low temperature and low humidity, however, the photosensitive member having the intermediate layer (R) containing only a single polyol compound caused a serious increase in light portion potential (Vl), bringing about a lowering of image density.

There was also an appearance of slight non-uniformity in the intermediate layer (R), but a smooth coating film was obtained in the intermediate layer (Q) of the present invention.

Example 10 & Comparative Example 10

The following two kinds of coating solutions were prepared as intermediate layer coating solutions.

| | |
|---|---|
| Intermediate resin layer (S): | |
| Poly(oxypropylene) triol (hydroxyl value: 365 mg · KOH/g) | 0.6 part |
| Tetrafunctional poly(oxypropylene) polyol formed using ethylenediamine as an initiator (hydroxyl value: 200 mg · KOH/g) | 1.1 parts |
| Hexamethylene diisocyanate | 1.4 parts |
| Triethylenediamine | 0.01 part |
| Intermediate resin layer (T): | |
| Poly(oxypropylene) triol (hydroxyl value: 365 mg · KOH/g) | 1.2 parts |
| Hexamethylene diisocyanate | 1.4 parts |
| Triethylenediamine | 0.01 part |

In these intermediate resin layers (S) and (T), the molar ratio of NCO group:OH group was 1.4:1.

Example 8 was repeated to prepare photosensitive members, except for using a coating solution obtained by dissolving each of the above compositions in 100 parts of isobutyl acetate. Evaluation was also made in the same way.

As a result, as Table 2 shows, stable characteristics were obtained in both cases under conditions of normal temperature and normal humidity. Under conditions of high temperature and high humidity, however, the photosensitive member having the intermediate layer (T) containing only a single polyol compound caused many image defects.

Under low temperature and low humidity, the photosensitive member having the intermediate layer (T) caused a serious increase in light portion potential (Vl), bringing about a lowering of image density.

There was also an appearance of much cissing in the intermediate layer (T), showing very poor coating properties. On the other hand, a smooth coating film was obtained in the intermediate layer (S) of the present invention.

Example 11 & Comparative Example 11

The following two kinds of coating solutions were prepared as intermediate layer coating solutions.

| | |
|---|---|
| Intermediate resin layer (U): | |
| Poly(oxypropylene) triol (hydroxyl value: 120 mg · KOH/g) | 2.0 parts |
| Hexafunctional poly(oxypropylene) polyol formed using sorbitol as an initiator (hydroxyl value: 555 mg · KOH/g) | 1.7 parts |
| meta-Xylene diisocyanate | 2.0 parts |
| Dibutyltin dilaurate | 0.02 part |
| Intermediate resin layer (V): | |
| Poly(oxypropylene) triol (hydroxyl value: 120 mg · KOH/g) | 8.3 parts |
| Hexafunctional poly(oxypropylene) polyol formed using sorbitol as an initiator (hydroxyl value: 555 mg · KOH/g) | 0.35 parts |
| meta-Xylene diisocyanate | 2.0 parts |
| Dibutyltin dilaurate | 0.02 part |

In these intermediate resin layers (U) and (V), the molar ratio of NCO group:OH group was 1:1.

Example 8 was repeated to prepare photosensitive members, except for using these coating solutions. Evaluation was also made in the same way.

As a result, as Table 2 shows, stable characteristics were obtained in both cases under conditions of normal temperature and normal humidity. Under conditions of low temperature and low humidity, however, the photosensitive member having the intermediate layer (V) in which one of the two kinds of polyol components having different functionality was in a proportion of 4% caused a serious increase in light portion potential (Vl), bringing about a lowering of image density.

There was also an appearance of non-uniformity in the intermediate layer (V) in which one of the two kinds of polyol components having different functionality was in a proportion of 4%. On the other hand, a smooth coating film was obtained in the intermediate layer (U) in which one of the polyol components was in a proportion of 46%.

Example 12 & Comparative Example 12

The following two kinds of coating solutions were prepared as intermediate layer coating solutions.

| | |
|---|---|
| Intermediate resin layer (W): | |
| Tetrafunctional poly(oxypropylene) polyol formed using ethylenediamine as an initiator (hydroxyl value: 510 mg · KOH/g) | 0.5 part |
| Octafunctional poly(oxypropylene) polyol formed using sucrose as an initiator (hydroxyl value: 440 mg · KOH/g) | 2.2 parts |
| meta-Xylene diisocyanate | 3.6 parts |
| Dimethyltin dilaurate | 0.01 part |
| Intermediate resin layer (X): | |
| Tetrafunctional poly(oxypropylene) polyol formed using ethylenediamine as an initiator (hydroxyl value: 510 mg · KOH/g) | 0.05 part |
| Octafunctional poly(oxypropylene) polyol formed using sucrose as an initiator (hydroxyl value: 440 mg · KOH/g) | 2.6 parts |
| meta-Xylene diisocyanate | 3.6 parts |
| Dimethyltin dilaurate | 0.01 part |

In these intermediate resin layers (W) and (X) , the molar ratio of NCO group: OH group was 1.8:1.

Example 5 was repeated to prepare photosensitive members, except for using no tolylene diisocyanate.

Evaluation was also made on these photosensitive members in the same way as in Example 5.

As a result, as Table 2 shows, both had a good sensitivity, and a sufficient potential contrast was obtained with a great difference between dark portion potential (Vd) and light portion potential (Vl). Even under conditions of high temperature and high humidity, there occurred no variations of dark portion potential, and good images were obtained.

In the meantime, images were continuously produced on 1,000 sheets of paper under conditions of low temperature and low humidity (15° C., 10% RH). As a result, the photosensitive member having the intermediate layer (W) in which one of the two kinds of polyol components having different functionality was in a proportion of 18% caused no increase in light portion potential (Vl), and very stable images were obtained. On the other hand, the photosensitive member having the intermediate layer (X) in which one of the polyol components was in a proportion of 2% caused fog because of a serious increase in light portion potential (Vl).

The intermediate layers each had an appearance of a smooth coating film.

Example 13

The following coating solution was prepared as an intermediate layer coating solution.

| | |
|---|---|
| Intermediate resin layer (Y): | |
| Poly(oxypropylene) glycol (hydroxyl value: 255 mg · KOH/g) | 1.7 parts |
| Poly(oxypropylene) triol (hydroxyl value: 225 mg · KOH/g) | 1.9 parts |
| Tetrafunctional poly(oxypropylene) polyol formed using ethylenediamine as an initiator (hydroxyl value: 200 mg · KOH/g) | 2.2 parts |
| Tolylenediisocyanate | 3.0 parts |
| Dibutyltin dilaurate | 0.01 part |

In this intermediate layer, the molar ratio of NCO group:OH group was 1.5:1.

Example 12 was repeated to prepare a photosensitive member, except for using a coating solution obtained by dissolving the above composition in 100 parts of isobutyl acetate. Evaluation was also made in the same way.

As a result, as Table 2 shows, stable characteristics were obtained in both cases under conditions of normal temperature and normal humidity, and also even under conditions of high temperature and high humidity and of low temperature and low humidity.

An appearance of a smooth coating film was also obtained in the intermediate layer (Y).

TABLE 2

| Photosensitive member | (1) | (3) | (I) (23° C., 55% RH) Dark portion potential Vd [−V] | (I) Light portion potential Vl [−V] | (II) (33° C., 90% RH) Dark portion potential Vd [−V] | (4) | (III) (15° C., 10% RH) Dark p. potential, Vd [−V] Initial stage | Dark p. potential, Vd [−V] 1,000 sheets | Light p. potential, Vl [−V] Initial stage | Light p. potential, Vl [−V] 1,000 sheets |
|---|---|---|---|---|---|---|---|---|---|---|
| Ex. 8 | 1.5 | A | 720 | 150 | 710 | A' | 730 | 720 | 150 | 160 |
| Cp. 8 | 1.5 | B | 725 | 145 | 650 | B' | 735 | 750 | 200 | 345 |
| Ex. 9 | 1.2 | A | 705 | 120 | 695 | A' | 710 | 705 | 130 | 135 |
| Cp. 9 | 1.2 | C | 715 | 170 | 680 | A' | 710 | 705 | 170 | 290 |
| Ex. 10 | 1.4 | A | 700 | 125 | 695 | A' | 690 | 695 | 130 | 125 |
| Cp. 10 | 1.4 | D | 700 | 140 | 605 | C' | 700 | 720 | 165 | 240 |
| Ex. 11 | 1.0 | A | 710 | 110 | 705 | A' | 710 | 710 | 125 | 130 |
| Cp. 11 | 1.0 | C | 690 | 120 | 690 | A' | 700 | 705 | 150 | 335 |
| Ex. 12 | 1.8 | A | 695 | 115 | 695 | A' | 700 | 705 | 120 | 120 |
| Cp. 12 | 1.8 | A | 705 | 125 | 700 | A' | 710 | 705 | 140 | 225 |

TABLE 2-continued

| Photosensitive member | (1) | (3) | (I) (23° C., 55% RH) Dark portion potential Vd [−V] | (I) Light portion potential Vl [−V] | (II) (33° C., 90% RH) Dark portion potential Vd [−V] | (4) | (III) (15° C., 10% RH) Dark p. potential, Vd [−V] Initial stage | Dark p. potential, Vd [−V] 1,000 sheets | Light p. potential, Vl [−V] Initial stage | Light p. potential, Vl [−V] 1,000 sheets |
|---|---|---|---|---|---|---|---|---|---|---|
| Ex. 13 | 1.5 | A | 725 | 125 | 715 | A' | 730 | 725 | 130 | 120 |

Ex.: Example;
Cp.: Comparative Example
(I): Normal temperature and normal humidity;
(II): High temperature and high humidity
(III): Low temperature and low humidity
(1): Molar ratio of NCO group/OH group in material
(3): Appearance of intermediate layer; A: smooth, B: slight cissing, C: non-uniform, D: much cissing
(4): Image; A': good, B': a little image defects, C': many image defects

What is claimed is:

1. An electrophotographic photosensitive member comprising a conductive support, a photosensitive layer and an intermediate layer interposed therebetween, wherein said intermediate layer comprises a polyether polyurethane derived from an isocyanate compound and a plurality of kinds of polyether polyol compounds, the polyether polyol compounds meeting at least one of the following requirements i) and ii):

i) a ratio of a weight average molecular weight of at least one polyether polyol compound to a weight average molecular weight of at least one other polyether polyol compound is 1.3 or more; and ii) at least one polyether polyol compound has different functionality from that in at least one other polyether polyol compound.

2. An electrophotographic photosensitive member according to claim 1, wherein a ratio of weight average molecular weight of at least one polyether polyol compound to a weight average molecular weight of at least one other polyether polyol compound is 1.3 or more and said polyether polyol compounds are each contained in an amount of not less than 20% by weight.

3. An electrophotographic photosensitive member according to claim 1, wherein the compounds having different functionality are each contained in an amount of not less than 5% by weight.

4. An electrophotographic photosensitive member according to claim 1, wherein said photosensitive layer contains an organic photoconductive material.

5. An electrophotographic photosensitive member according to claim 1, wherein said photosensitive layer comprises a single layer.

6. An electrophotographic photosensitive member according to claim 1, wherein said photosensitive layer comprises a charge generation layer containing a charge-generating material and a charge transport layer containing a charge-transporting material.

7. An electrophotographic photosensitive member according to claim 1, wherein the polyether polyurethane is derived from an isocyanate compound selected from the group consisting of aromatic isocyanate compounds, hydrogenated aromatic isocyanate compounds, blocked hydrogenated aromatic isocyanate compounds, blocked aromatic isocyanate compounds, aliphatic isocyanate compounds, blocked aliphatic isocyanate compounds and a plurality of kinds of polyether polyol compounds, said polyether polyol compounds selected from the group consisting of poly (oxyalkylene) glycols, poly (oxyalkylene) triols and poly (oxyalkylene) polyols.

8. An electrophotographic apparatus which comprises an electrophotographic photosensitive member comprising a conductive support, a photosensitive layer and an intermediate layer interposed therebetween, said intermediate layer comprising a reaction product of an isocyanate compound and a plurality of kinds of polyether polyol compounds, the polyether polyol compounds meeting at least one of the following requirements i) and ii):

i) a ratio of a weight average molecular weight of at least one polyether polyol compound to a weight average molecular weight of at least one other polyether polyol compound is 1.3 or more; and ii) at least one polyether polyol compound has different functionality from that in at least one other polyether polyol compound.

* * * * *

UNITED STATES PATENT AND TRADEMARK OFFICE

CERTIFICATE OF CORRECTION

PATENT NO. : 5,362,587

DATED : November 8, 1994

INVENTOR(S) : YUICHI HASHIMOTO, ET AL.

It is certified that error appears in the above-identified patent and that said Letters Patent is hereby corrected as shown below:

ON TITLE PAGE

In [57] ABSTRACT, Line 1: "The" should be deleted.

IN THE DRAWINGS

Sheet 1 of 1, FIG. 2: "READIND" should read --READING--.

COLUMN 1

Line 10, "1990now" should read --1990 now--.

COLUMN 12

Line 23, "coating coating" should read --coating--.

COLUMN 17

Line 14, "layer (0)" should read --layer (0)--.

COLUMN 20

TABLE 2, In "Cp. 12": "710 705" should read --710 725--.

UNITED STATES PATENT AND TRADEMARK OFFICE

CERTIFICATE OF CORRECTION

PATENT NO. : 5,362,587

DATED : November 8, 1994

INVENTOR(S) : YUICHI HASHIMOTO, ET AL.

It is certified that error appears in the above-identified patent and that said Letters Patent is hereby corrected as shown below:

COLUMN 22

Line 38, "reaction product of" should read --polyether polyurethane derived from--.

Signed and Sealed this

Ninth Day of May, 1995

Bruce Lehman

*Attest:*

BRUCE LEHMAN

*Attesting Officer*

*Commissioner of Patents and Trademarks*